US008511890B2

(12) United States Patent
Andren et al.

(10) Patent No.: US 8,511,890 B2
(45) Date of Patent: Aug. 20, 2013

(54) ROCKING BEZEL CONTROL

(75) Inventors: Bo Stefan Andren, Portland, OR (US); Brad N. Clarkson, Beaverton, OR (US); Stephen Dylan Berry, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 767 days.

(21) Appl. No.: 11/511,090

(22) Filed: Aug. 27, 2006

(65) Prior Publication Data

US 2008/0049562 A1 Feb. 28, 2008

(51) Int. Cl.
*G04C 9/00* (2006.01)
*G04B 37/00* (2006.01)

(52) U.S. Cl.
USPC ..... 368/187; 368/295

(58) Field of Classification Search
USPC ..... 368/295, 187–189, 294
See application file for complete search history.

(56) References Cited

U.S. PATENT DOCUMENTS

| | | | | |
|---|---|---|---|---|
| 2,472,351 | A | 6/1949 | Tyler | |
| 3,675,414 | A | 7/1972 | Cachelin | |
| 4,178,751 | A | 12/1979 | Liataud | |
| 4,194,351 | A | 3/1980 | Kume et al. | |
| 4,229,936 | A | 10/1980 | Schneider | |
| 4,462,697 | A | 7/1984 | Thompson | |
| 4,638,409 | A | 1/1987 | Berman | |
| 4,704,037 | A | 11/1987 | Kroner | |
| 4,708,492 | A | 11/1987 | Mock et al. | |
| 4,727,524 | A | 2/1988 | Shoji et al. | |
| 4,897,826 | A | 1/1990 | Rigberg et al. | |
| 4,958,279 | A | 9/1990 | Proellochs | |
| 5,010,532 | A | 4/1991 | Perrot | |
| 5,500,837 | A | 3/1996 | Flury | |
| 5,899,370 | A | 5/1999 | Bould | |
| 6,224,254 | B1 | 5/2001 | Hayek et al. | |
| 6,556,222 | B1 | 4/2003 | Narayanaswami | |
| D474,984 | S | 5/2003 | Wilson | |
| 6,619,836 | B1 | 9/2003 | Silvant et al. | |
| 6,728,166 | B2 | 4/2004 | Grupp | |
| 6,766,182 | B2 * | 7/2004 | Janninck et al. | 455/575.3 |
| 6,775,206 | B2 * | 8/2004 | Karhu | 368/10 |
| 6,796,708 | B2 | 9/2004 | Kawamata et al. | |
| 6,857,775 | B1 | 2/2005 | Wilson | |
| 6,968,508 | B2 * | 11/2005 | Lucaci et al. | 715/784 |
| 6,971,789 | B2 | 12/2005 | Nakamura | |

(Continued)

FOREIGN PATENT DOCUMENTS

| | | |
|---|---|---|
| EP | 0383180 | 8/1990 |
| EP | 0389441 | 9/1990 |

(Continued)

OTHER PUBLICATIONS

International Search Report and Written Opinion in corresponding PCT Application No. PCT/US2007/016854.

(Continued)

*Primary Examiner* — Sean Kayes
(74) *Attorney, Agent, or Firm* — Banner & Witcoff, Ltd.

(57) ABSTRACT

A control for operating a portable electronic device includes a bezel surrounding a display for the portable electronic device. The bezel is resiliently supported so that it can rock toward the electronic device. One or more portions of the bezel are then positioned relative to inputs for the electronic device, such that rocking of the bezel activates at least one input.

12 Claims, 5 Drawing Sheets

(56) References Cited

U.S. PATENT DOCUMENTS

| | | | | |
|---|---|---|---|---|
| 7,114,845 | B2 | 10/2006 | Wilson | |
| 2001/0004397 | A1* | 6/2001 | Kita et al. | 381/334 |
| 2002/0101457 | A1* | 8/2002 | Lang | 345/856 |
| 2003/0043698 | A1* | 3/2003 | Guerry et al. | 368/282 |
| 2003/0174589 | A1 | 9/2003 | Kawamata et al. | |
| 2007/0008824 | A1* | 1/2007 | Cretin | 368/69 |

FOREIGN PATENT DOCUMENTS

| | | |
|---|---|---|
| JP | 52-036060 | 3/1977 |
| JP | 62-239081 | 10/1987 |
| WO | 2004012176 A1 | 2/2004 |

OTHER PUBLICATIONS

International Preliminary Report on Patentability for Application No. PCT/US2007/016854, mailed Mar. 12, 2009, 7 pages.

PCT/US2008/056491, International Search Report and Written Opinion, dated Feb. 26, 2009.

Final Office Action for U.S. Appl. No. 11/725,154, mailed Feb. 16, 2010, 10 pages.

* cited by examiner

ROCKING BEZEL CONTROL

FIELD OF THE INVENTION

The present invention relates to an electronic control implemented by a rocking bezel.

Various examples of the invention may be particularly applicable to a rocking bezel control for controlling the operation of a portable electronic device, such as a digital music player.

BACKGROUND OF THE INVENTION

Portable electronic devices have become ubiquitous in our modern society. For example, people ranging from college students to professionals may simultaneously carry a personal digital assistant (PDA), a mobile telephone, and a digital music player (such as an MP3 player). Even young children are beginning to use mobile telephones and digital music players.

While portable electronic devices are convenient, their very portability creates problems that did not exist with larger, semi-permanently located electronic devices.

First, manufacturers are continuously reducing the size of portable electronic devices, in order to enhance their portability. This size reduction inherently reduces the area available on portable electronic devices to place buttons, knobs, switches, or other controls for operating the electronic device. Second, portable electronic devices frequently are operated while the user is moving. For example, many users will operate a digital music player while running, exercising in a gym, bicycling, skiing, or engaging in some other athletic activity. For most people, this movement prohibits the operation of small controls that require precise hand-eye coordination.

BRIEF SUMMARY OF THE INVENTION

Accordingly, it would be desirable to have a control mechanism that allows a user to more easily operate an electronic device. Various embodiments of the invention provide a portable electronic device control including a bezel surrounding a display for the portable electronic device. The bezel is resiliently supported so that it can rock toward and away from the electronic device. One or more portions of the bezel then are positioned relative to inputs for the electronic device, such that rocking of the bezel toward or away from the portable electronic device activates at least one input of the portable electronic device.

DETAILED DESCRIPTION OF THE INVENTION

Figure 1:
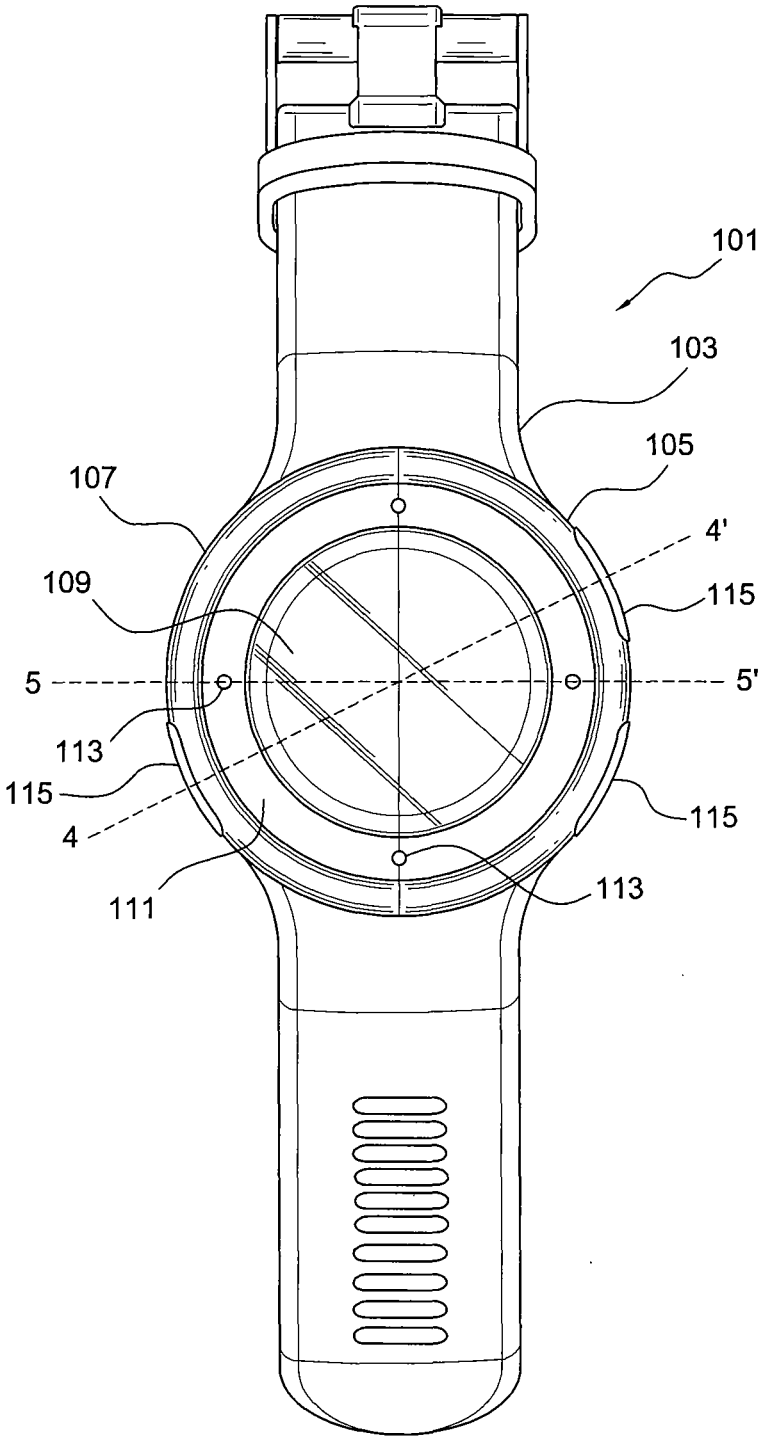
FIG. 1 is a top planar view of a wristwatch implementing a rocking bezel control according to various examples of the invention.
Figure 2:
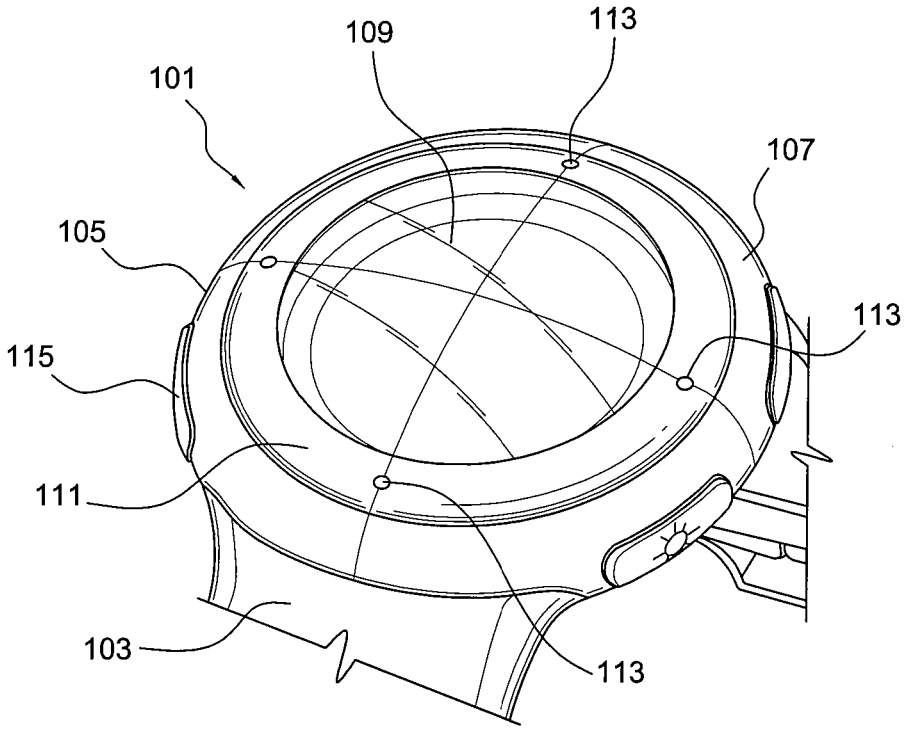
FIG. 2 is a perspective view of the wristwatch illustrated in FIG. 2.

FIGS. 1 and 2 illustrate an example of a portable electronic device. More particularly, these figures illustrate a portable electronic device implemented as a wristwatch 101, which includes a band 103 and a watch 105. As will be discussed in more detail below, the watch 105 may perform a variety of functions. For example, in addition to being a chronometer, the watch 105 may also function as a stopwatch, a timer, a compass, an altimeter, a digital music player, a thermometer, a barometer, a remote control for another electronic device (either portable or stationary), or some combination thereof.

With various implementations of invention, the band 103 may be formed of any desirable material, such as, for example, polyurethane, rubber, leather, a woven fabric, interconnected links of inflexible material (such as metal or rigid plastic), or some other combination of material or materials that form a flexible structure. In the illustrated example, the band 103 is semi-permanently affixed to the watch 105. With alternate embodiments of the invention, however, the band 103 may be affixed to the watch 105 so that it is easily removable.

The watch 105 includes a casing 107 and a display module 109. The casing 107 encloses the electrical and/or mechanical components that implement the chronometer and other functions of the watch 105. The display module 109 then displays the output data produced by the functional components of the watch 105. As will be discussed in more detail below, the display module 109 may, for example, include a liquid crystal display (LCD), a light emitting diode (LED) display, an organic light emitting (OLE) display, one or more analog rotating hands or dials, or another type of display using any other desired technology.

The watch 105 also includes a bezel 111. Conventionally, the term "bezel" refers to the surface ring of a watch that surrounds the watch's crystal and holds the crystal in place.

As used herein, however, the term bezel refers to any ring which separates at least the upper portion of a display module for an electronic device from the upper portion of a casing for the electronic device. With various examples of the invention, the bezel may have a circular, elliptical, polygonal or irregular shape. Further, the bezel may be independent from the display module of the electronic device, and serve no function with respect to holding a lens or cover for the display module in position.

With various examples of the invention, the bezel will "rock" relative to a primary plane of the electronic device, as will be discussed in more detail below. That is, the primary plane of the bezel can be rotated relative to the primary plane of the portable electronic device about an axis parallel to both the primary plane of the bezel and the primary plane of the portable electronic device. As will also be discussed in more detail below, the rocking movement of the bezel can thus be used to control the operation of one or more functions of the electronic device.

For example, with the watch 105 illustrated in FIGS. 1 and 2, the bezel 111 separates the upper portion of the display module 109 from the upper portion of the casing 107.

As will be discussed in more detail below, however, the bezel 111 is independent from the display module 109. The bezel 111 includes a plurality of bezel control indicators 113. As will also be discussed in more detail below, each of these bezel control indicators 113 marks a location where the bezel 111 can be depressed to control some operation of the watch 105. The bezel control indicators 113 may be graphical marks printed on or engraved into the bezel 111, raised areas on the surface of the bezel 111, depressions in the surface of the bezel 111, or any combination thereof.

In addition to the bezel 111, the watch 105 may optionally include one or more control buttons 115 for controlling one or more operations of the watch 105. In the illustrated example, the control buttons 115 are positioned along the side of the casing 107. With other examples of the invention, however, the control buttons 115 may alternately or additionally be positioned on the upper portion of the casing 107, or even extend through an aperture in the bezel 111. Of course, with some examples of the invention, the control buttons 115 may be omitted altogether.

Figure 3:
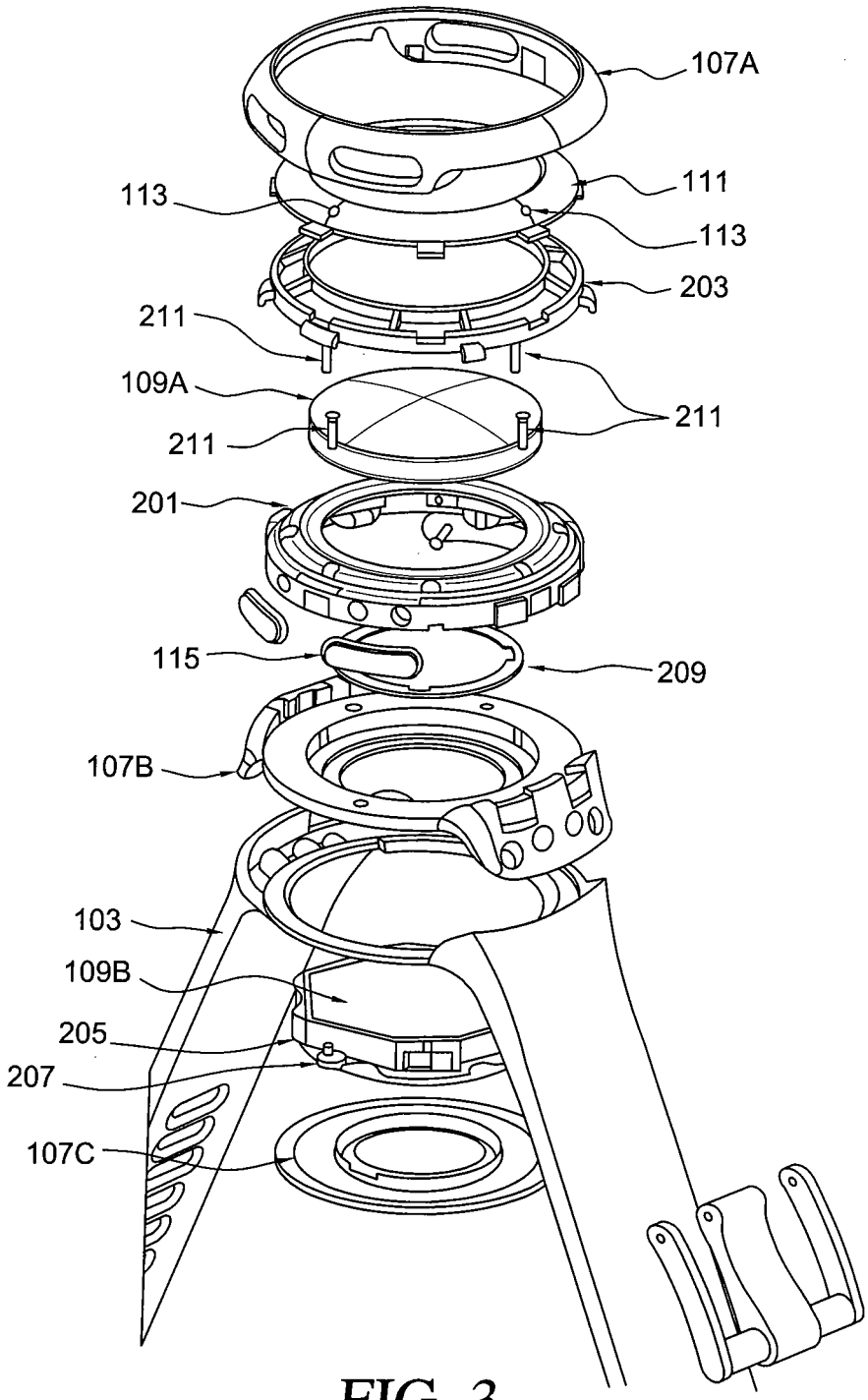
FIG. 3 is an exploded perspective view of the wristwatch illustrated in FIGS. 1 and 2.

Turning now to FIG. 3, this figure illustrates an exploded perspective view of the components of the wristwatch 101 illustrated in FIGS. 1 and 2. As seen in this figure, the watch casing 107 includes an upper casing portion 107A, a bottom casing portion 107B, and a battery hatch 107C. The bottom casing portion 107B supports an inner casing 201, which in turn supports a spring 203. The spring 203 itself may then be co-molded to match the bottom surface of the bezel 111. With various examples of the invention, the spring 203 is formed of a resilient material, which can be compressed but which will have a tendency to return to its original shape.

For example, the spring 203 may be formed of a polyurethane or rubber. As will be discussed in greater detail below, forming the spring 203 of sufficiently resilient material will pressure the bezel 111 to maintain its primary plane at a constant position relative to the primary plane of the watch 105. With the watch 105 illustrated in FIGS. 1-3, the primary plane of the bezel 111 is substantially parallel to the primary plane of the watch 105. When a user presses down on a portion of the bezel 111 to rock it, the user thus will feel some resistance provided by the resiliency of the spring 203. Further, when the user stops pressing down on that portion of the bezel 111, the resiliency of the spring 203 will force the bezel 111 back to its original position (i.e., with the primary plane of the bezel 111 parallel to the primary plane of the watch 105).

As previously noted, the bezel 111 may be rocked, potentially exposing the inner casing 201 to debris and moisture. Accordingly, the spring 203 may additionally act as a barrier to prevent debris and moisture from collecting underneath the bezel 111 is rocked. As will be appreciated by those of ordinary skill in the art, forming the spring 203 of a resilient material will improve the ability of the spring 203 to block debris and moisture from reaching underneath the bezel 111.

The functional components of the watch 105 are contained within a watch module assembly 205. With various examples of the invention, one or more functions of the watch 105 are implemented by electronic circuitry. For example, the watch 105 may provide a chronometer function, a stopwatch function, a timer function, an altimeter function, a digital music player function, a thermometer function, a barometer function, or a remote control function for another electronic device using a microprocessor, a memory circuit, and one or more electronic sensors. Similarly, if the watch 105 implements one or more functions (e.g., a chronometer, stopwatch, or timer function) using mechanical components, then these mechanical components may be housed within the watch module assembly 205 as well.

As will be appreciated by-those of ordinary skill in the art, the electronic circuitry used to implement one or more functions of the watch 105 will require some input from a user. For example, if the watch 105 includes electronic circuitry to implement a chronometer function, then that circuitry will include one or more input devices that a user can manipulate to set a desire time. Likewise, if the watch 105 includes electronic circuitry to implement a digital music player function (or to implement a remote control function for operating a remote digital music player), then that electronic circuitry typically will include one or more input devices that a user can manipulate to begin, stop, pause, forward and reverse the playback of a digital music file.

Accordingly, the watch module assembly 205 will include one or more input devices 207 for controlling the operation of electronic circuitry housed within the watch module assembly 205. With some examples of the invention, the input devices 207 will be simple switches (i.e., electronic devices that have only an on or off state). For example, the input devices 207 illustrated in FIG. 3 are dome switches. With this type of switch, two separated electrodes are positioned beneath a dome of deformable material. The inner surface of the dome then is formed of a conductive material such that, when pressure is applied to deform the dome, the inner surface contacts both electrodes to complete an electric circuit. Of course, other examples of the invention alternately or additionally may use other types of input devices 207.

Depending upon the configuration of the electronic circuitry housed within the watch module assembly 205, the functions of the watch can be controlled by some designated actuation of the input devices 207. For example, an operation of the electronic circuitry can be initiated by actuating an input device 207, actuating multiple input devices 207 (either together or in a particular sequence), maintaining one or more input devices 207 in an "on" or "off" state for a preset amount of time, etc. A wide variety of techniques for controlling electronic circuitry using input devices is well known, and thus will not be discussed here in further detail.

In addition to the input devices 207, the watch module assembly 205 also includes a display 109A, which forms a component of the display module 109. As previously noted, the display 109A may be a liquid crystal display (LCD), a light emitting diode (LED) display, an organic light committing display, one or more conventional analog rotating hands, or a display implemented using any other desirable technology. The display module 109 also include a transparent lens 109B, such as a mineral lens (i.e., a crystal), which covers the display 109A to protect it from damage. In the illustrated example, the lens 109B is adhered to the top surface of the watch module assembly 205. With alternate examples of the invention, however, the lens 109B may be held in place by grooves formed in the bezel 111, and thus rock with the bezel 111.

A hatch plate 209 is affixed to a strap assembly formed by the bottom casing portion 107B and the strap 103. The strap assembly is then affixed using, e.g., screws to the module assembly 205. The battery hatch 107C is removably attached to the hatch plate 209. In this manner, the battery hatch 107C can be removed to connect a battery to power the electronic circuitry housed in the watch module assembly 205. The battery hatch 107C can then be reattached to the hatch plate 209 to protect the battery and the watch module assembly 205 from debris and moisture.

The watch 105 also includes a plurality of pushers 211. As illustrated in FIG. 3, each pusher 211 extends from the bezel 111 toward an input device 207. More particularly, each pusher 211 is located between a portion of the bezel 111 with a bezel control indicator 113 and an input device 207. Accordingly, when a user depresses the bezel 111 at a position with a bezel control indicator 113, the resulting rocking movement of the bezel 111 will in turn move the pusher 211 located below the bezel control indicator 113 toward its corresponding input device 207. If the bezel 111 is depressed with sufficient force, the pusher 211 will push down against the input device 207 to actuate it.

Figure 4:
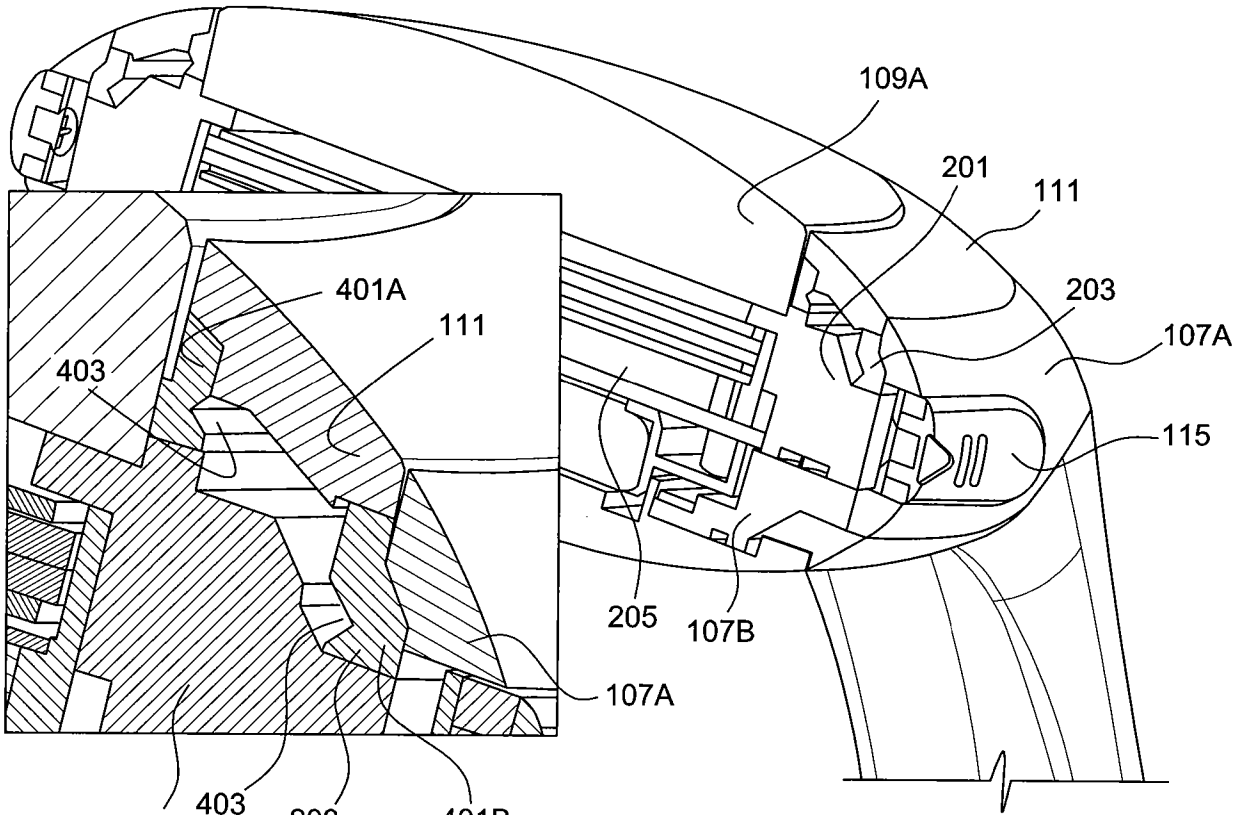
FIG. 4 is a perspective cross-sectional view along lines 4-4' in FIG. 1.
Figure 5:
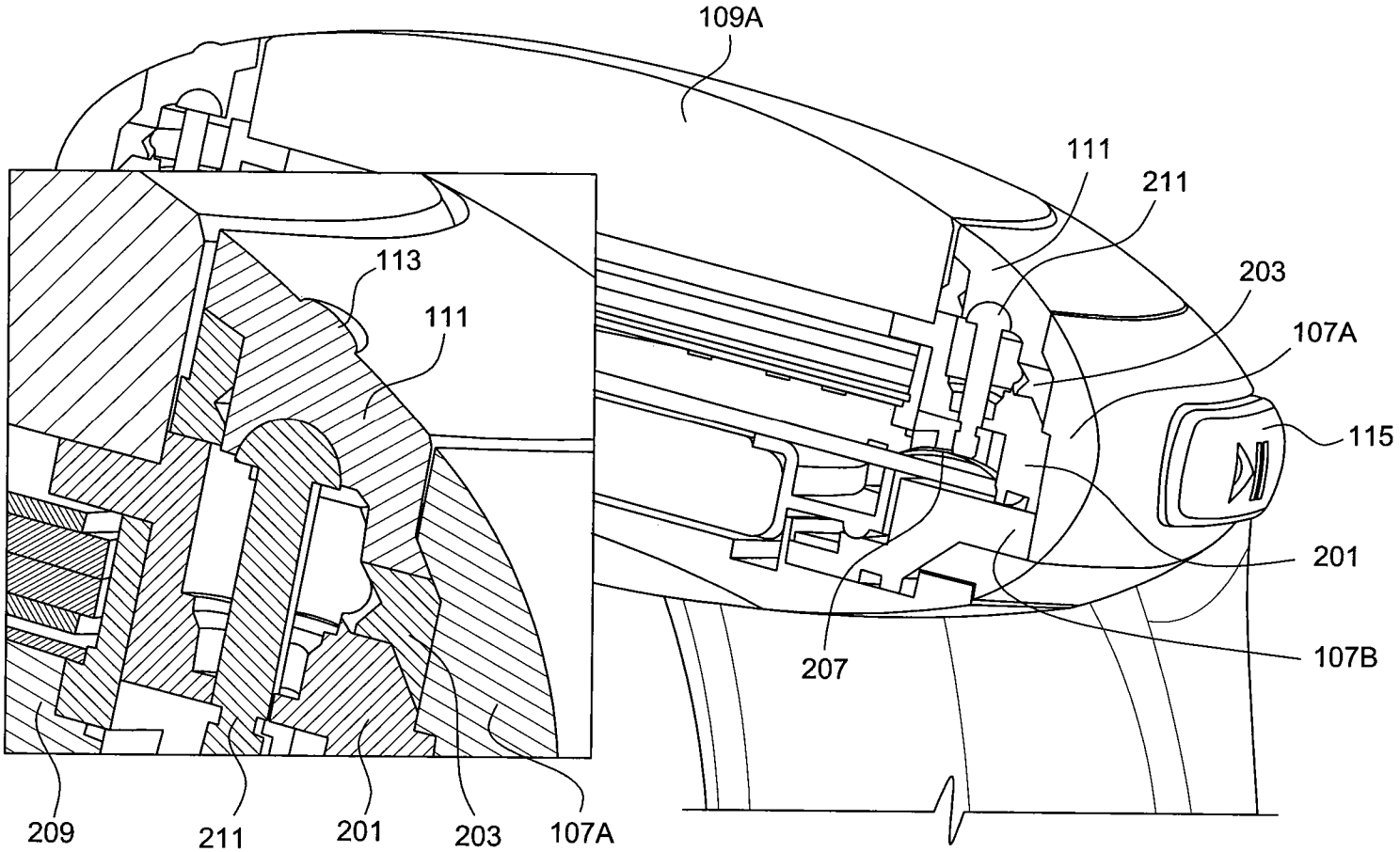
FIG. 5 is a perspective cross-sectional view along lines 5-5' in FIG. 1.

The interaction of the bezel 111, the spring 203, the pushers 211, and the input devices 207 will be more apparent with reference to FIGS. 4 and 5. FIG. 4 is a perspective, cross sectional view of the watch 105. As seen in this figures, the spring 203 has two walls 401A and 401B. The first spring wall 401A is adjacent to the lens 109A, while the second spring wall 401B is adjacent to the upper casing portion 107A, leaving a space between the spring walls 401. Each spring wall 401 defines a groove 403 facing the space between the spring walls 401. Accordingly, when a user presses down on a portion of the bezel 111, the spring walls 401 can collapse at the grooves 403. This allows the pressed portion of the bezel 111 to move toward the lower casing portion 107B. The remaining portions of the bezel 111, however, will continue to be supported by the spring 203. Thus, the bezel 111 will rock toward the lower casing portion 107B (i.e., the primary plane of the bezel 111 rotates relative to the primary plane of the watch 105.

The effect of rocking the bezel 111 can be seen in FIG. 5. As seen in this figure, the pusher 211 has a hemispherical upper portion and a grooved lower portion. The grooved portion may allow a clip, such as an "e-clip" (not shown), to be attached to the pusher stem 211 to help secure it in place. The hemispherical upper portion is embedded in the lower portion of the bezel 111, below a bezel control indicator 113. As a result, when the bezel 111 is depressed at a bezel control indicator 113, the pusher 211 located below the bezel control indicator 113 moves toward its corresponding input device 207. If the bezel 111 is depressed with sufficient force, the pusher 211 will push down against its corresponding input device 207. In the illustrated example, the input device 207 is formed by a dome switch. Accordingly, the pusher 211 will deform the top of the dome so that it connects the electrodes underneath the dome. When the user stops pressing the bezel 111 at the bezel control indicator 113, the resiliency of the spring 203 will push that portion of the bezel 111 back to its original position. Thus, the bezel 111 will rock back so that the primary plane of the bezel 111 resumes its original orientation relative to the primary plane of the watch 105. As seen in this figure, portions of the bezel 111 may have a lip 501 that extends underneath the upper casing portion 107A, so as to prevent the bezel 111 from rocking away from the watch 105.

It should be appreciated that alternate examples of the invention may employ different type of input devices 207. For example, with some embodiments of the invention, each input device 207 may consist of two or more separate electrodes, and the bottom portion of the pusher 211 may be provided with a conductive surface. Accordingly, when the pusher 211 contacts the electrodes, the conductive surface of the pusher 211 will connect the electrodes to complete an electric circuit. Alternately, each input device 207 may consist of a transistor, with one electrode of the transistor (e.g., a gate electrode) facing its corresponding pusher 211. Each pusher 211 may then be connected to a voltage source sufficiently large such that, when the pusher 211 contacts the transistor electrode, the voltage carried by the pusher 211 activates the transistor. Still further, the input device 207 may consist of a light source and an optical detector. With this arrangement, movement of the bezel 111 will push the pusher 211 between the light source and the optical detector, to trigger a change in the state of the optical detector. Of course, still other structures can be used to implement the input devices 207. Thus, the watch module assembly 205 detects the rocking of the bezel 111 toward (or away from) the watch module assembly 205 through some type of input device 207. In response, the watch module assembly 205 will perform some function.

It also should be appreciated that structures other than the spring 203 may be used to resiliently support the bezel 111. For example, with some embodiments of the invention, different types of springs, such as leaf springs, coiled springs, or any other desired type of spring may alternately or additionally be used to resiliently support the bezel 111. The springs may be, for example, leaf springs positioned between the bezel 111 and the upper casing portion 107A or the watch module assembly 205, or between the pushers 211 and the lower casing portion 107B or the watch module assembly 205. The springs also may be coil springs that, e.g., are wrapped around the pushers 211 or positioned between the bezel 111 and the upper casing portion 107A or the watch module assembly 205. Of course, still other structures can be used to resiliently support the bezel 111 while allowing portions of the bezel 111 to rock toward and back from the input devices 207. With some implementations of the invention, the spring walls 401 of the input devices 207 may be used, either by themselves or in conjunction with one or more other types of springs, to support the bezel 111 so that it can rock toward and away from the watch module assembly 205.

With various examples of the invention, the watch 105 will provide a digital music player function, or a remote control for a digital music player function. Accordingly, with these implementations of the invention, rocking the upper portion of the bezel 111 (relative to FIG. 1) toward the watch module assembly 205 may cause the corresponding digital music player (either included in the watch 105 or remotely controlled by the watch 105) to display a control menu through the display 109. Similarly, rocking the lower portion of the bezel 111 (relative to FIG. 1) toward the watch module assembly 205 may cause the corresponding digital music player to play music or pause playing music. Rocking the left portion of the bezel 111 (relative to FIG. 1) toward the watch module assembly 205 may then cause the corresponding digital music player to skip back to play a previous audio file in a playlist, while rocking the right portion of the bezel 111 (relative to FIG. 1) toward the watch module assembly 205 may cause the corresponding digital music player to skip forward and play the next audio file in a playlist. Of course, alternate functions may be assigned to correspond with each of the input devices 207.

Still further, it should be appreciated that various embodiments of the invention may include fewer or more input devices 207 than the four input devices 207 illustrated in the particular example of the invention shown in FIG. 1-5. For example, some embodiments of the invention may have five or more input devices 207 arranged around the circumference of the bezel 111. Also, while particular examples of the invention have been described with reference to a wristwatch 101, various embodiments of the invention may be employed with any portable electronic device having a display and one or more controls. For example, various embodiments of the invention can be employed with a hand-held digital music player, radio, CD player, wireless telephone or the like.

Conclusion

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A control for an electronic device, comprising:

a display;

a bezel surrounding the display and defining a primary plane;

an electronic module for controlling an electronic device, the electronic module having at least one input device that provides input signals to the electronic module when activated;

a casing encasing the display, the bezel, and the electronic module, wherein a maximum diameter of the casing at a widest portion thereof is greater than a maximum diameter of the bezel;

a support for the bezel that allows the bezel to be rocked such that the primary plane of the bezel rotates relative to the casing; and at least one pusher that moves in response to rocking of the bezel to activate the at least one input device.

2. The control recited in claim 1, wherein the support is a spring for the springing a gap between the casing and the bezel.

3. The control recited in claim 2, wherein the spring is formed of flexible polyurethane or rubber.

4. The control recited in claim 1, wherein the support includes at least one spring.

5. The control recited in claim 1, wherein the at least one pusher is a cylindrical rod.

6. The control recited in claim 1, wherein the at least one pusher extends through an opening defined in the support.

7. The control recited in claim 1, wherein the electronic module is a controller for a digital music player.

8. The control recited in claim 1, wherein the electronic module has chronographic functions.

9. The control recited in claim 1, wherein the electronic module is a remote controller for a separate electronic device.

10. The control recited in claim 1, further comprising a user input component extending through an aperture of the bezel.

11. The control recited in claim 1, wherein the casing surrounds the bezel along a circumferential edge of the bezel.

12. A control for an electronic device, comprising:

a display;

a bezel surrounding the display and defining a primary plane;

an electronic module for controlling an electronic device, the electronic module having at least one input device that provides input signals to the electronic module when activated;

a casing encasing the display, the bezel, and the electronic module, wherein at least a portion of the casing overlays at least a portion of the bezel in a direction orthogonal to a surface of the display;

a support for the bezel that allows the bezel to be rocked such that the primary plane of the bezel rotates relative to the casing; and at least one pusher that moves in response to rocking of the bezel to activate the at least one input device.

* * * * *